US005992409A

United States Patent [19]

Heimlich et al.

[11] Patent Number: 5,992,409

[45] Date of Patent: Nov. 30, 1999

[54] CATALYTIC RADIANT TUBE HEATER AND METHOD FOR ITS USE

[75] Inventors: Yehuda Heimlich, Mevasseret Zion; Vladmir Meiklyar, Jerusalem; Vladimir Rozenshtein, Hahadasha, all of Israel

[73] Assignee: Catalytic Systems Technologies Ltd., Jerusalem, Israel

[21] Appl. No.: 08/932,052

[22] Filed: Sep. 17, 1997

Related U.S. Application Data

[63] Continuation-in-part of application No. 08/759,341, Dec. 2, 1996.

[51] Int. Cl.[6] ..... F24C 3/00

[52] U.S. Cl. ..... 126/91 A; 431/328

[58] Field of Search ..... 431/328; 126/91 A

[56] References Cited

U.S. PATENT DOCUMENTS

| | | | |
|---|---|---|---|
| 3,119,439 | 1/1964 | Weiss | 431/328 |
| 3,425,675 | 2/1969 | Twine | 126/91 A |
| 4,746,287 | 5/1988 | Lannuitti | 431/328 |
| 4,809,672 | 3/1989 | Kendall et al. | 126/91 A |

*Primary Examiner*—Carroll B. Dority
*Attorney, Agent, or Firm*—Mark M. Friedman

[57] ABSTRACT

A catalytic gas radiant tube heater, and a method for its use. A radiant tube encloses a catalyst tube containing a catalyst on a catalyst support. Air and a gaseous hydrocarbon fuel diffuse into the catalyst support and react on the catalyst surfaces. The reaction heats the catalyst tube, causing the catalyst tube to emit infrared radiation, which heats the radiant tube from within, causing the radiant tube to emit infrared radiation. The infrared radiation emitted by the radiant tube is directed in the desired direction by a reflector. The preferred catalyst is cobalt chromium oxide spinel.

21 Claims, 6 Drawing Sheets

CATALYTIC RADIANT TUBE HEATER AND METHOD FOR ITS USE

This is a continuation-in-part of U.S. patent application Ser. No. 08/759,341, filed Dec. 2, 1996.

FIELD AND BACKGROUND OF THE INVENTION

The present invention relates to space heaters and, more particularly, to a device and method for producing infrared radiation to heat the surrounding area.

The most common way to heat the contents, such as people, of a restricted space, such as a chilly room, is to heat the air within that space. A more efficient way of achieving the same results is to direct infrared radiation at the targets to be heated, as well as at surfaces such as walls and floors in the restricted space, thereby eliminating the need to use warm or hot air as an intermediary. The targets and the irradiated surfaces then become an ensemble of low-temperature radiant re-emitters. Because infrared energy is absorbed solely where it is directed, it is possible to divide the restricted space into separate smaller zones and to maintain a different comfort level in each zone. Objects in contact with the floor are warmed both by direct radiation and by conduction from the floor. This method of space heating has been applied to a wide variety of locations, including warehouses, garages, greenhouses, transportation terminals, airplane hangers, gymnasia, tennis courts, farm and industrial buildings and loading docks.

The most common way to generate the infrared radiation is by using a gas radiant tube heater, as illustrated schematically in FIG. 1. The components of a conventional gas radiant tube heater include a radiant tube 10, a control and combustion system 12, a fuel inlet 14, an air inlet 16, an exhaust fan 18 and a reflector 20. A gaseous hydrocarbon fuel such as methane is introduced to control and combustion system 12 via fuel inlet 14. Air, as a source of oxygen, is introduced to control and combustion system 12 via air inlet 16, which may be as simple as a hole in the side of control and combustion system 12. Control and combustion system 12 ignites the resulting air-fuel mixture at the left end of radiant tube 10, producing hot reaction products, which, when they contact the inner wall of radiant tube 10, are at a temperature of about 500° C. at the left end of radiant tube 10 and at a temperature of about 150° C. at the right end of radiant tube 10. These reaction products ideally include only water vapor and carbon dioxide, but often also include carbon monoxide, soot and nitrogen oxides. Exhaust fan 18 pulls these reaction products through radiant tube 10, heating radiant tube 10 and causing radiant tube 10 to emit infrared radiation. Reflector 20 directs this infrared radiation in the desired direction. For example, if the gas radiant tube heater of FIG. 1 were mounted on the ceiling of a room, reflector 20 would be positioned as shown to direct the infrared radiation downward. An illustrative example of a gas radiant tube heater may be found in U.S. Pat. No. 5,429,112, to Rozzi.

Structurally, the only requirement that must be satisfied by radiant tube 10 are that it be sufficiently sturdy to withstand the temperatures generated therewithin by the hot products of the combustion of the fuel in the atmospheric oxygen. Preferably, the outer surface of radiant tube 10 is treated to promote efficient emission of infrared radiation, for example by painting the outer surface of radiant tube 10 black, using a high temperature black paint. Typically, radiant tube 10 is a cylinder from 3 meters to 30 meters in length and from 4 inches to 6 inches in diameter, although other shapes are used. For example, the radiant tube of the Rozzi patent is U-shaped. Typically, the temperature of the outer surface of radiant tube 10 reaches an operating temperature of between 400° C. at the left end of radiant tube 10 and 100° C. at the right end of radiant tube 10.

Conventional gas radiant heaters suffer from the following limitations:

1. Fuel and air must be introduced to control and combustion system 12 in near-stoichiometric proportions. The resulting mixture may explode in case of heater malfunction.

2. As noted above, the reaction products often include pollutants such as carbon monoxide, soot and nitrogen oxides.

3. The relevant components of control and combustion system 12 and radiant tube 10 (for example, the left end of radiant tube 10 where the combustion takes place) must be sufficiently sturdy to withstand the combustion temperatures of between 1300° C. and 1900° C.

4. Because of the temperature drop along radiant tube 10, the infrared radiation is emitted inhomogeneously.

The invention of the Rozzi patent cited above was directed specifically at limitations numbers 1 and 3. Limitations numbers 2 and 4 are inherent to conventional gas radiant heaters.

There is thus a widely recognized need for, and it would be highly advantageous to have, a design for gas radiant heaters that would overcome the disadvantages of presently known systems as described above.

SUMMARY OF THE INVENTION

According to the present invention there is provided a radiant tube heater, for reacting a gaseous hydrocarbon fuel with atmospheric oxygen to produce reaction products and heat, including: (a) a radiant tube; (b) a catalyst tube, within the radiant tube; and (c) a catalyst, within the catalyst tube, for catalyzing the reaction of the fuel with the atmospheric oxygen.

According to the present invention there is provided a method for generating infrared radiation, including the steps of: (a) providing a radiant tube heater including: (i) a radiant tube, (ii) a catalyst tube, within the radiant tube, and (iii) a catalyst, within the catalyst tube, for catalyzing a reaction of a gaseous hydrocarbon fuel with atmospheric oxygen; and (b) introducing the fuel into the catalyst tube.

The present invention is based on the catalytic combustion of a gaseous hydrocarbon fuel. As in the case of the conventional gas radiant tube heater described above, the central component of the device of the present invention is a radiant tube; but instead of burning the fuel at one end of the radiant tube, the present invention places a catalyst tube, containing a suitable catalyst, inside the radiant tube. Air and fuel are introduced to the device and diffuse into the catalyst tube, where they react on the surface of the catalyst, heating the catalyst tube to a temperature of between 400° C. and 750° C., depending on the type of fuel and catalyst used. The heated catalyst tube emits infrared radiation, predominantly at a wavelength between 2 microns and 16 microns. This radiation heats the radiant tube from within to a somewhat lower temperature, depending on the exact geometries of the radiant tube and the catalyst tube. The radiant tube then radiates infrared radiation at a somewhat longer wavelength, corresponding to the somewhat lower temperature of the radiant tube. Because of the lower temperature of catalytic combustion compared with free burning, the components of the device of the present invention, particularly the radiant tube, need not be as robust as the corresponding components of the prior art devices, and no oxides of nitrogen are produced. Furthermore, a stoichiometric mixture of air and fuel is not necessary. The reaction proceeds in the presence of excess air, and so proceeds to completion, so that no incomplete combustion products such as carbon monoxide and soot are formed. Preferably, the catalyst tube extends substantially the full length of the radiant tube, and the fuel and air are delivered to the catalyst tube uniformly throughout the length of the catalyst tube. The reaction then proceeds at the same rate throughout the catalyst tube, and both the catalyst tube and the radiant tube are heated uniformly.

Preferably, the catalyst tube is a double-walled hollow cylinder, with the catalyst supported on a catalyst support between the two walls. The walls of the catalyst tube are perforated, to allow air and fuel to diffuse in and to allow reaction products to diffuse out. A fuel inlet tube, coaxial with the catalyst tube, runs the entire length of the catalyst tube. The fuel inlet tube is perforated along its length to allow fuel introduced via the fuel inlet tube to enter the interior of the catalyst tube and diffuse uniformly to the catalyst through the inner wall of the catalyst tube. In one embodiment of the device of the present invention, air is mixed with the fuel, and both the air and the fuel diffuse to the catalyst via the inner wall of the catalyst tube. In another embodiment of the device of the present invention, air enters the gap between the inner wall of the radiant tube and the outer wall of the catalyst tube, and diffuses to the catalyst via the outer wall of the catalyst tube. As in the case of the conventional gas radiant tube heater, an exhaust fan is provided to remove reaction products from the device of the present invention, and a reflector is provided to direct the infrared radiation, emitted by the radiant tube, in the desired direction.

Although the scope of the present invention includes all suitable catalyst supports and all suitable catalysts, the preferred support is a porous and permeable mass of silica or alumina fibers, for example a woven sheet or a felt of silica or alumina fibers, and the preferred catalyst is cobalt chromium oxide spinel. This catalyst allows the fuel to be delivered at a rate such that the air diffuses to the catalyst in a proportion to the fuel far in excess of stoichiometric, and also allows the use of any gaseous hydrocarbon fuel, including methane, ethane, propane and butane.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a gas radiant tube heater in which the gaseous fuel reacts flamelessly with atmospheric oxygen, in the presence of a catalyst.

The principles and operation of a gas radiant tube heater according to the present invention may be better understood with reference to the drawings and the accompanying description.

Figure 2A:
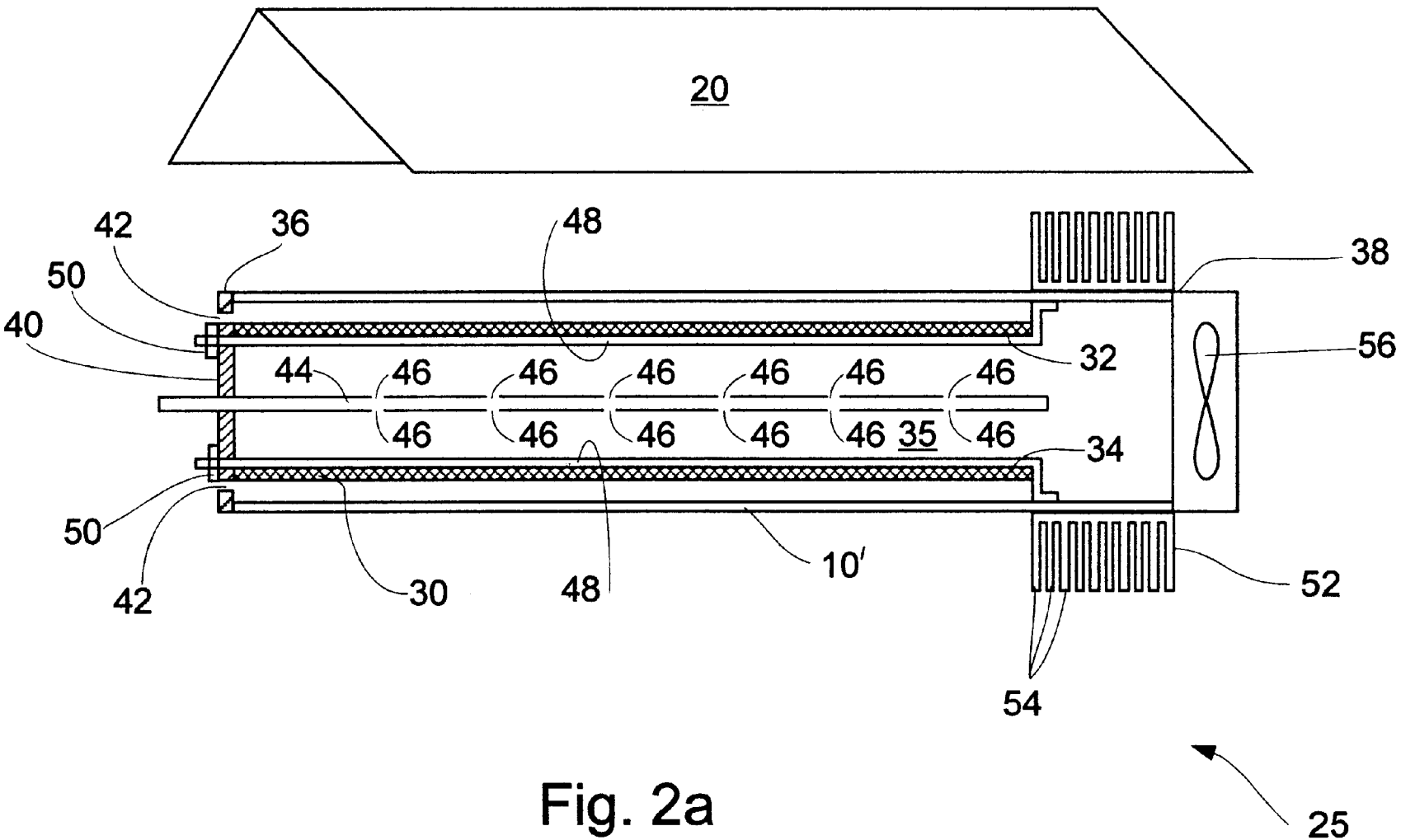
FIGS. 2A and 2B are schematic longitudinal cross sections of two variants of a first embodiment of a gas radiant tube heater of the present invention.

Referring now to the drawings, FIG. 2A is a schematic longitudinal cross-section of a first preferred embodiment 25 of the present invention. Radiant tube 10' is a hollow cylinder, of circular cross section. Within radiant tube 10', coaxial with radiant tube 10', and extending substantially the full length of radiant tube 10', is a cylindrical catalyst tube 30, also of circular cross section. Catalyst tube 30 includes a perforated cylindrical wall 32 and a perforated cylindrical outer wall 34, between which is disposed a suitable catalyst, as illustrated below in FIG. 3. Inner wall 32 defines an interior chamber 35. Coaxial with catalyst tube 30 and running the full length of catalyst tube 30 is a fuel inlet tube 44. Distributed along the length of fuel inlet tube 44 are apertures 46 to allow fuel introduced into fuel inlet tube 44 to enter chamber 35. The density of apertures 46 along fuel inlet tube 44 increases from inlet end 36 of radiant tube 10' towards outlet end 38 of radiant tube 10', so that fuel is introduced to chamber 35 uniformly along the full length of chamber 35. Inlet end 36 of radiant tube 10' is closed by an inlet cover 40. A central hole is provided in inlet cover 40 to admit fuel inlet tube 44. Inlet cover 40 also is provided with peripheral apertures 42 to admit air into the gap between the inner wall of radiant tube 10' and outer wall 34 of catalyst tube 30. Fuel introduced to chamber 35 diffuses from chamber 35 to the space between inner wall 32 and outer wall 34 via inner wall 32.

Air entering the gap between the inner wall of radiant tube 10' and outer wall 34 diffuses into the space between inner wall 32 and outer wall 34 via outer wall 34.

A support structure is provided to support catalyst tube 30 within radiant tube 10'. This support structure includes a plurality of support rods 48 that are firmly secured to radiant tube 10' towards outlet end 38 of radiant tube 10'. At inlet end 36, support rods 48 protrude through holes in inlet cover 40. The ends of support rods 48 are threaded, and both catalyst tube 30 and inlet cover 40 are secured to support rods 48 by nuts 50 in the conventional manner. The support structure also includes longitudinal reinforcing rings (not shown) that connect support rods 48. This support structure allows easy removal and replacement of catalyst tube 30: nuts 50 are removed from support rods 48, inlet cover 40 is removed, and catalyst tube is slid leftward off of support rods 48.

Figure 1:
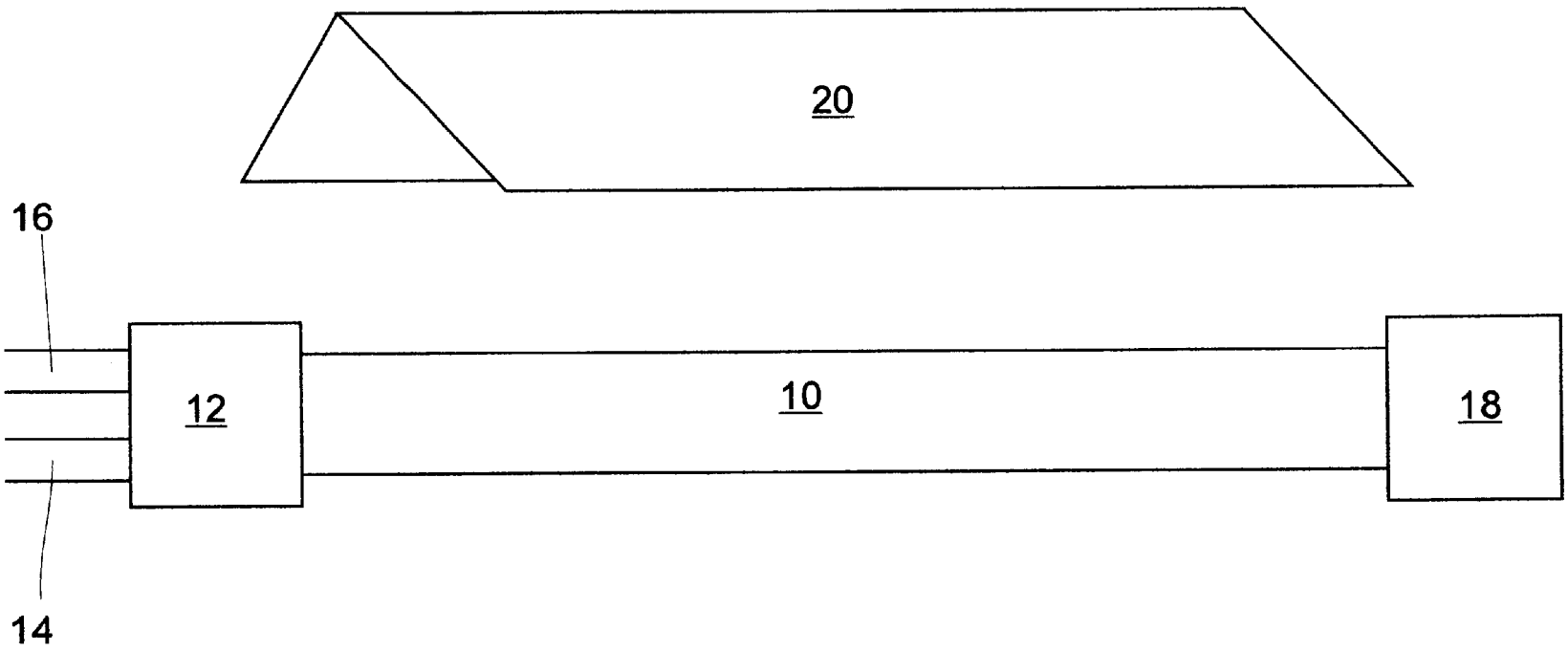
Fig. 1 (PRIOR ART)
FIG. 1 is a schematic illustration of a prior art gas radiant tube heater.

As in the case of the conventional gas radiant tube heater of FIG. 1, radiant tube heater 25 includes an exhaust fan 56, at outlet end 38 of radiant tube 10', for removing reaction products from radiant tube 10', and a reflector 20, alongside radiant tube 10', to reflect infrared radiation from radiant tube 10' in the desired direction. Exhaust fan 56 pulls reaction products out of outlet end 38 of radiant tube 10'.

Towards outlet end 38, radiant tube 10' is enclosed in a radiator 52. The function of radiator 52 is to cool hot combustion products before those reaction products are removed by exhaust fan 56. The particular radiator 52 shown here is an air-cooled radiator, made of a good heat conductor such as copper and having cooling fins 54. In alternative embodiments, a liquid-cooled radiator is used.

Figure 3:
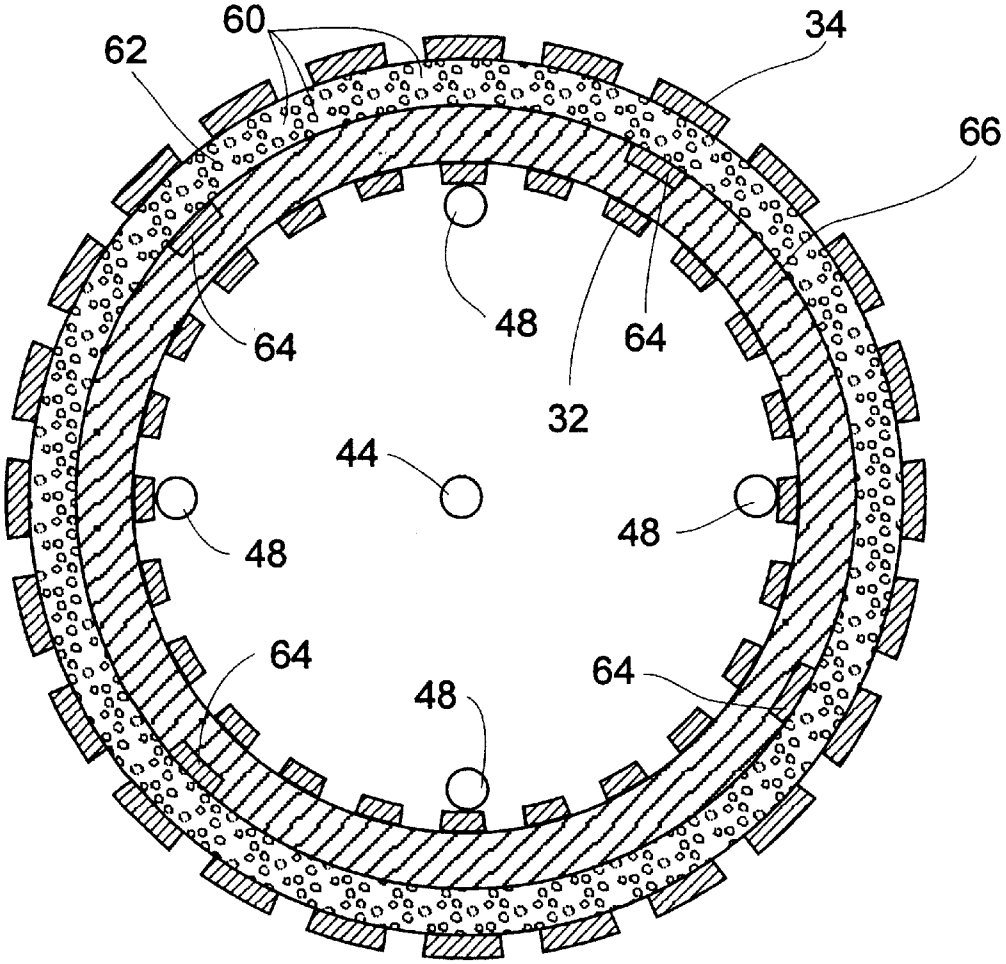
FIG. 3 is a partial schematic transverse cross section of the gas radiant tube heater of FIG. 2A.

FIG. 3 is a schematic transverse cross section of catalyst tube 30 and fuel inlet tube 44. Catalyst tube 30 is bounded by two coaxial perforated cylindrical walls: inner wall 32 and outer wall 34, so that catalyst tube 30 has an annular transverse cross section, enclosing chamber 35 and fuel inlet tube 44. Inner wall 32 is shown supported by support rods 48. Within, coaxial with, and adjacent to outer wall 34 is a cylindrical woven sheet 62 of catalyst support material, preferably made of fibers of silica or alumina, on which is supported a catalyst, represented schematically by circles 60. Catalyst 60 preferably is cobalt chromium oxide spinel, having a chemical formula $(Co^{2+})_A(Co^{3+}{}_{2\delta}Cr^{3+}{}_{2-2\delta})_B O^{2-}{}_4$, where δ is the fraction of $Co^{+3}$ ions in the octahedral sublattice of the spinel, and A and B denote the tetrahedral and octahedral sublaticces, respectively. Typically, 30% by weight of catalyst support 62 consists of catalyst 60. With this proportion of catalyst 60 in catalyst support 62, the energy output of catalytic tube 30 is between 2 Watts and 7 Watts per $cm^2$ of catalyst support 62.

Cobalt chromium oxide spinel catalyst 60 is deposited on catalyst support 62 by the following steps:

1. Dissolve $Cr(NO_3)_3 \cdot 9H_2O$ and $Co(NO_3)_2 \cdot 6H_2O$ in water, in a proportion that gives the desired stoichiometry after calcination.

2. Saturate the support material with the chromium nitrate-cobalt nitrate solution.

3. Dry the impregnated support material at 100° C. –110° C. for 10–12 hours.

4. Calcination: heat the dried support material at a rate of 5° C. –10° C. per minute to a calcination temperature of 600° C. –650° C. Maintain the calcination temperature for 3–5 hours.

Alternatively, one or more soluble salts of alkali metals, alkaline earth metals, or iron may be added to the solution of step 1 to increase the stability of the catalyst.

Between inner wall 32 and catalyst support 62 is a gas distributing layer 66 of a porous and permeable material 63 which preferably is identical to the material of catalyst support 62. As noted above, walls 32 and 34 are perforated, grid-like structures, to allow free diffusion of fuel from chamber 35 into catalyst support 62 and free diffusion of air from outside of catalyst tube 30 into catalyst support 62. The purpose of gas distributing layer 66 is to ensure that fuel diffuses uniformly to catalyst support 62. Preferably, catalyst support 62 is between 1 cm and 2 cm thick, so that air and gas can diffuse from opposite surfaces of catalyst support 62 in high enough concentrations to support combustion.

Running longitudinally along the inner surface of catalyst support 62 are four electrically conducting strips 64. The purpose of strips 64 is to heat catalyst support 62 to initiate the combustion catalyzed by catalyst 60. Preferably, strips 64 are made of nichrome and are about 0.5 mm thick and about 2 mm wide. An electrical switch with a timer (not shown) provides electrical current to strips 64. Running a current of about 10 amps through strips 64 for between two minutes and three minutes typically is sufficient to heat catalyst support 62 to the temperature of between 150° C. and 350° C. needed to initiate combustion. After combustion is initiated, it is self-supporting.

Figure 2B:
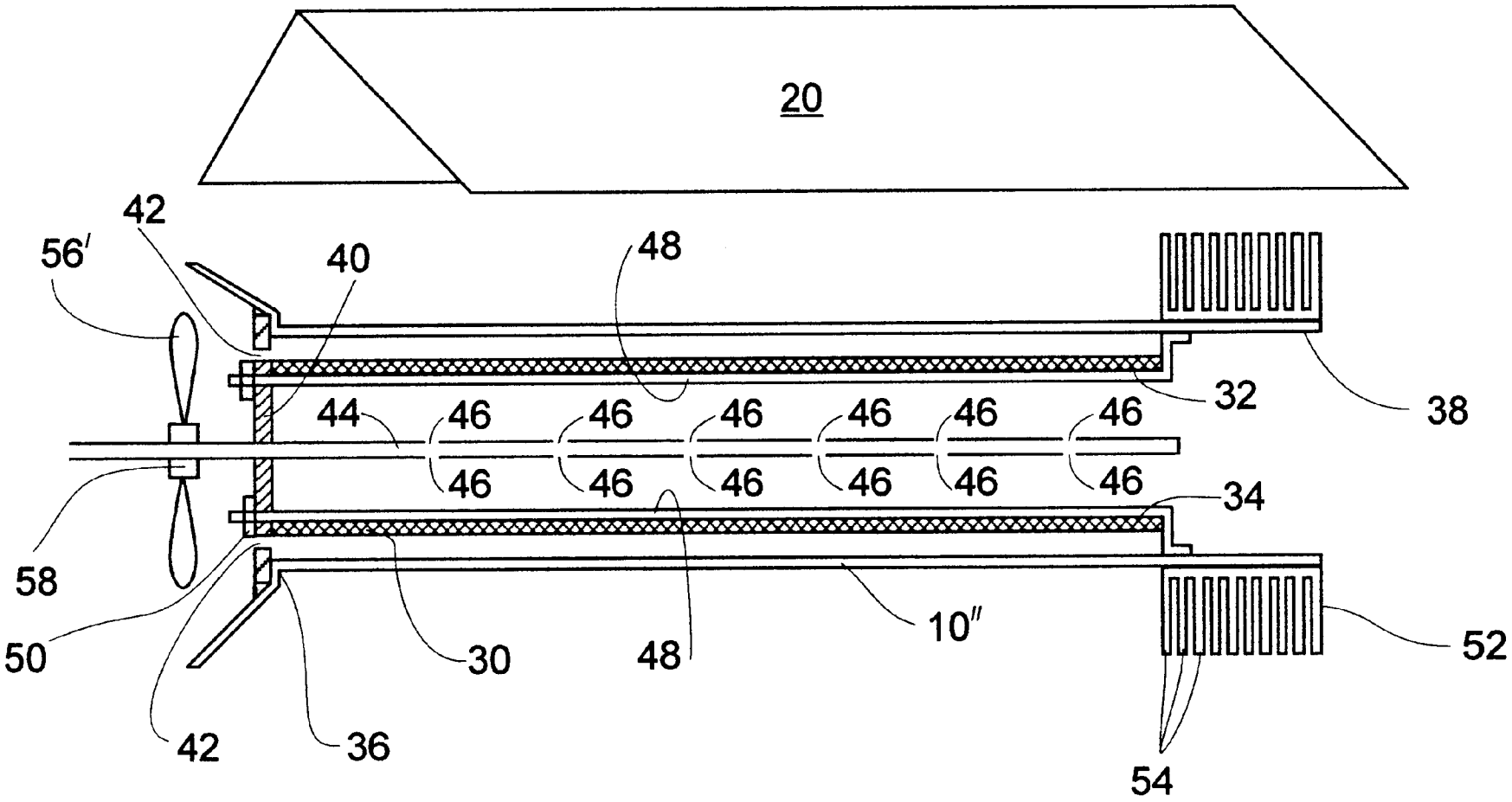

FIG. 2B is a schematic longitudinal cross section of a variant of the embodiment of FIG. 2A. The embodiment of FIG. 2B is substantially identical to the embodiment of FIG. 2A, except that instead of exhaust fan 56 at outlet end 38 of radiant tube 10', an exhaust fan 56' is positioned at an inlet end 36' of a radiant tube 10". Exhaust fan 56' is mounted on a hollow hub 58 through which runs fuel inlet tube 44. Exhaust fan 56' both pulls air into apertures 42 and pushes reaction products out of an outlet end 38' of radiant tube 10".

Figure 4:
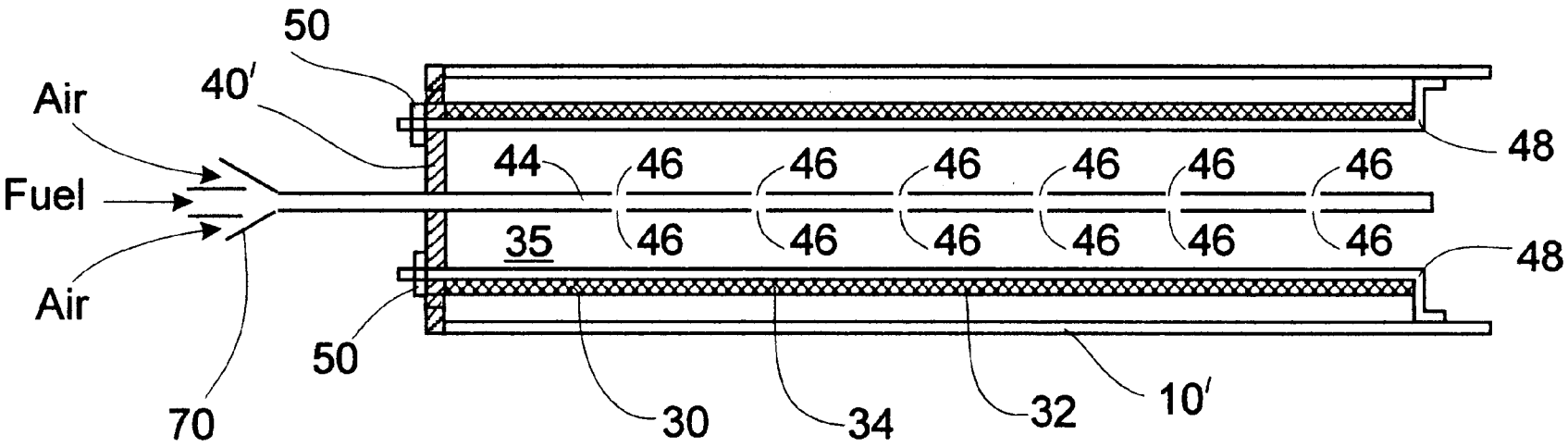
FIG. 4 is a partial schematic longitudinal cross section of a second embodiment of a gas radiant tube heater of the present invention.

FIG. 4 is a partial schematic longitudinal cross section of a second preferred embodiment of the present invention. The difference between the embodiment of FIG. 4 and the embodiment of FIG. 2 is that in the embodiment of FIG. 4, air and fuel are mixed, by means of a mechanism represented by a funnel 70, before being introduced to chamber 35 via a gas inlet tube 44' which is otherwise substantially identical to fuel inlet tube 44. Correspondingly, inlet cover 40' of the embodiment of FIG. 4 lacks peripheral air apertures 42. The air-fuel mixture diffuses into catalyst support 62 via inner wall 32, and reaction products diffuse out of catalyst tube 30 via both inner wall 32 and outer wall 34. In all other respects, the embodiment of FIG. 4 is substantially identical to the embodiment of FIG. 2.

Prototypes of both preferred embodiments of the present invention were constructed and tested. Catalyst tubes 30 of both prototypes were 1 m long and 10 cm in diameter. The fuel used was propane. The catalyst used was the cobalt chromium oxide spinel described above. In both cases, the ignition temperature was 150° C. and outer wall 34 of catalyst tube 30 reached a temperature of 600° C.

Although the preferred embodiments illustrated herein show catalyst tube 30 coaxial with radiant tube 10', the scope of the present invention includes all suitable geometric arrangements of catalyst tube 30 within radiant tube 10'. For example, catalyst tube 30 may be in the shape of a helical coil.

Figure 5:
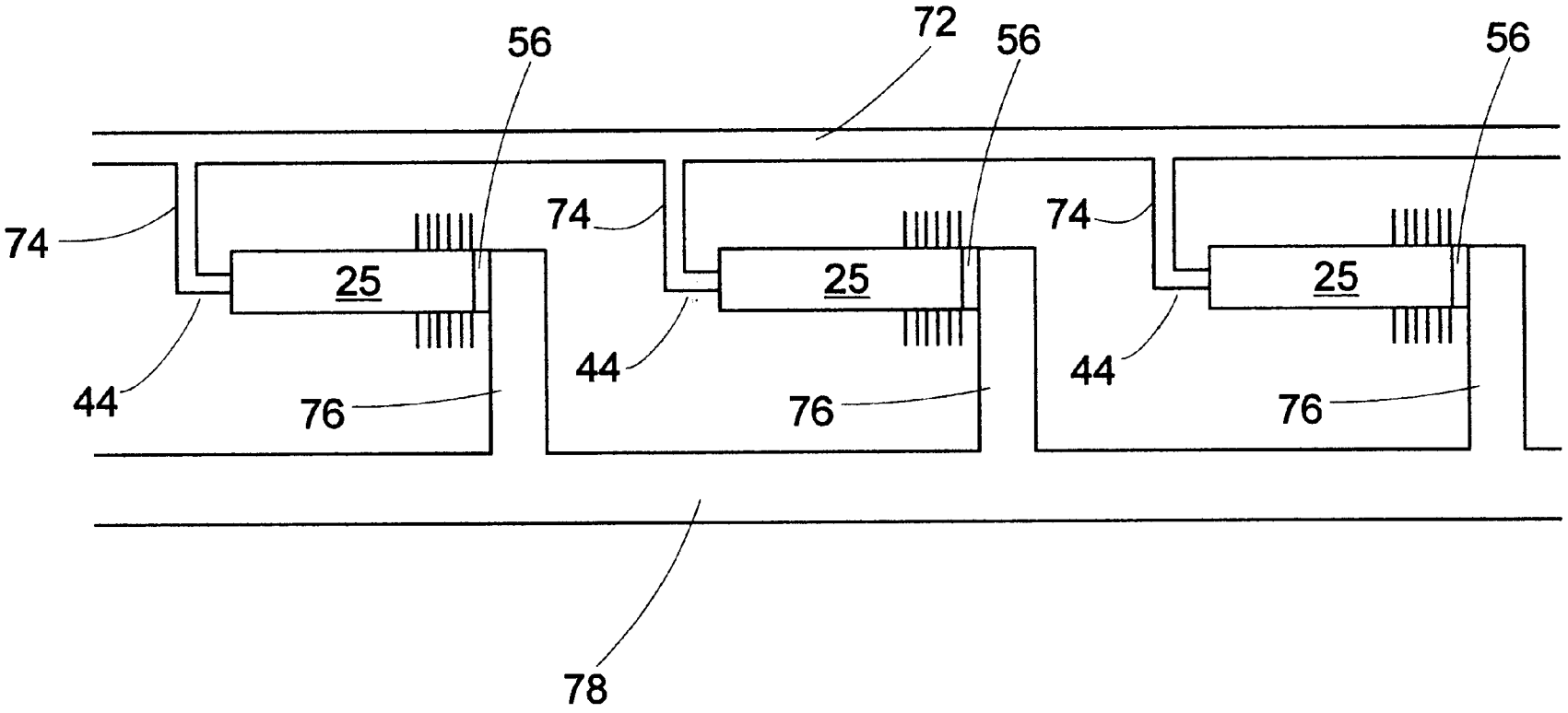
FIG. 5 illustrates the modularity of the present invention.

FIG. 5 is a schematic illustration of the modularity of the device of the present invention. Three gas radiant tube heaters 25 are connected in parallel to a fuel delivery line 72 and a flue 78. Fuel inlet tube 44 of each gas radiant tube heater 25 receives fuel from fuel delivery line 72 by a fuel distribution line 74. Exhaust fan 56 of each gas radiant tube heater 25 expels reaction products to flue 78 via a duct 76. Each gas radiant tube heater 25 operates independently, so that any one of gas radiant tube heaters 25 can be taken off-line for maintenance or replacement without disrupting the performance of the entire system.

While the invention has been described with respect to a limited number of embodiments, it will be appreciated that many variations, modifications and other applications of the invention may be made.

What is claimed is:

1. A radiant tube heater, for reacting a gaseous hydrocarbon fuel with atmospheric oxygen to produce reaction products and heat, comprising:

(a) a radiant tube;

(b) a catalyst tube, within said radiant tube; and (c) a catalyst, within said catalyst tube, for catalyzing the reaction of the fuel with the atmospheric oxygen.

2. The radiant tube heater or claim 1, wherein said radiant tube has two ends, and wherein said catalyst tube extends substantially from one of said ends to another of said ends.

3. The radiant tube heater of claim 2, wherein said radiant tube and said catalyst tube are substantially cylindrical and coaxial.

4. The radiant tube heater of claim 1, wherein said catalyst includes cobalt chromium oxide spinel.

5. The radiant tube heater of claim 1, further comprising:

(d) a mechanism for introducing the fuel into said catalyst tube.

6. The radiant tube heater of claim 5, wherein said catalyst tube is annular, thereby defining therewithin a chamber, and wherein said mechanism for introducing the hydrocarbon gas into said catalyst tube includes a fuel inlet tube within said chamber.

7. The radiant tube heater of claim 1, wherein said radiant tube has at least one end, said radiant tube heater further comprising:

(d) a mechanism, positioned at said at least one end, for exhausting the reaction products from said radiant tube.

8. The radiant tube heater of claim 7, wherein said mechanism pulls the reaction products out of said radiant tube.

9. The radiant tube heater of claim 7, wherein said mechanism pushes the reaction products out of said radiant tube.

10. The radiant tube heater of claim 1, further comprising:

(d) a mechanism, located within said catalyst tube, for initiating the reaction of the fuel and the oxygen.

11. The radiant tube heater of claim 1, wherein said mechanism for initiating the reaction includes an electrically conductive element.

12. The radiant tube heater of claim 1, further comprising:

(d) a catalyst support, within said catalyst tube, whereon said catalyst is supported.

13. The radiant tube heater of claim 12, wherein said catalyst support includes fibers of a material selected from the group consisting of silica and alumina.

14. The radiant tube heater of claim 1, further comprising:

(d) a reflector, alongside said radiant tube.

15. A method for generating infrared radiation, comprising the steps of:

(a) providing a radiant tube heater including:

(i) a radiant tube, (ii) a catalyst tube, within said radiant tube, and (iii) a catalyst, within said catalyst tube, for catalyzing a reaction of a gaseous hydrocarbon fuel with atmospheric oxygen; and (b) introducing said fuel into said catalyst tube.

16. The method of claim 15, wherein said reaction produces reaction products, the method further comprising the step of:

(c) exhausting said reaction products from said radiant tube.

17. The method of claim 16, wherein said exhausting is effected by pulling said reaction products from said radiant tube.

18. The method of claim 16, wherein said exhausting is effected by pushing said reaction products from said radiant tube.

19. The method of claim 15, further comprising the step of:

(c) heating said catalyst to a temperature of between about 150° C. and about 350° C., thereby initiating said reaction.

20. The method of claim 19, wherein said radiant tube heater further includes:

(iv) an electrically conductive element within said catalyst tube; said heating of said catalyst being effected by introducing an electric current into said element.

21. The method of claim 15, wherein said radiant tube heater further includes:

(iv) a reflector, alongside said radiant tube; the method further comprising the step of:

(c) positioning said reflector with respect to said radiant tube so as to direct the infrared radiation in a desired direction.

* * * * *